United States Patent [19]

Iijima et al.

[11] Patent Number: 4,671,075

[45] Date of Patent: Jun. 9, 1987

[54] HEAT PUMP SYSTEM

[75] Inventors: Hitoshi Iijima; Naoki Tanaka; Masaki Ikeuchi, all of Hyogo, Japan

[73] Assignee: Mitsubishi Denki Kabushiki Kaisha, Tokyo, Japan

[21] Appl. No.: 872,710

[22] Filed: Jun. 10, 1986

[30] Foreign Application Priority Data

Mar. 5, 1986 [JP] Japan ..... 61-47651

[51] Int. Cl.[4] ..... F25B 41/00; F25B 49/00

[52] U.S. Cl. ..... 62/196.1; 62/196.3; 62/197; 62/278

[58] Field of Search ..... 62/117, 196.1, 196.3, 62/196.4, 197, 278

[56] References Cited

U.S. PATENT DOCUMENTS

| | | | |
|---|---|---|---|
| 3,371,500 | 3/1968 | Marcus, Jr. | 62/117 |
| 3,807,192 | 4/1974 | Porter | 62/197 |
| 4,326,868 | 4/1982 | Ozu et al. | 62/117 X |
| 4,499,739 | 2/1985 | Matsuoka et al. | 62/212 |

*Primary Examiner*—Lloyd L. King

*Attorney, Agent, or Firm*—Wolf, Greenfield & Sacks

[57] ABSTRACT

A heat pump system in which a by-passing passage is provided for connecting a high pressure segment of a primary refrigerant passage with a low pressure segment of the primary refrigerant passage, a secondary pressure reduction means is disposed in the by-passing passage to produce two phases of the refrigerant (gas-liquid state) and the pressure of the refrigerant is continuously detected by sensing saturated temperatures of the two phases both upstream and downstream of the secondary pressure reduction means for controlling the operation of the system.

15 Claims, 8 Drawing Figures

HEAT PUMP SYSTEM

FIELD OF INVENTION

The present invention relates to a heat pump apparatus and more particularly to a heat pump apparatus the operation of which is controlled effectively with a compact and economical sensing means.

BACKGROUND OF INVENTION

A conventional heat pump system comprises a compressor, a condenser, an evaporator, a pressure reduction means normally disposed between the condenser and the evaporator and circulating passage connecting the elements above in which a heat transfer medium is circulated. An operation of such apparatus is usually controlled by detection of the outlet pressure at an outlet of the compressor and the inlet pressure at an inlet of the compressor and, based on the detected values, the respective elements of the system may be controlled by, such as, varying the rotational speed of fans associated with the condenser and/or evaporator or the revolutional speed of the compressor.

In the conventional heat pump system referred to above, it has been necessary to provide means such as a pressure switch or a pressure sensor for detecting the degree of pressure at certain points within the system. In a case where the pressure is to be detected at plural points, provision of plural pressure switches or pressure sensors is naturally required which provision necessitates additional expense, thus making the total capital cost of the system expensive. Further, in a case where employment of pressure switches is effected, the critical pressure value therefor is pre-set in advance so that detection of continuous variations in the pressure is impossible, the switch only being operable at the pre-set value. Accordingly, it has been impossible to effectively control the system in response to continuous variations in the pressure, quite apart from the high cost of the total system.

SUMMARY OF INVENTION

Accordingly, it is an object of the present invention to provide a heat pump system which may be operated by reliably sensing continuous variations of the pressure within the system so as to effectively control the heat pump system, as well as to make it possible for such a heat pump system to be provided at an economical cost.

This object is accomplished by a heat pump system constructed in accordance with the present invention.

The heat pump system according to the present invention comprises a by-passing passage in addition to the primary passage involved in the conventional system, the elements of which are connected by the primary passage in the sequence of compressor, condenser, pressure reduction means and evaporator. Such primary passage is divided into a high pressure segment and a low pressure segment, the high pressure system extending from an outlet of the compressor to an inlet of the pressure reduction means and the low pressure segment extending from an outlet of the pressure reduction means to an inlet of the compressor. The by-passing passage provided in the present invention connects the high pressure segment to the low pressure segment through a second pressure reduction means whereby the by-passing passage is divided into a first conduit upstream of the second pressure reduction means and a second conduit downstream of the second pressure reduction means. The refrigerant directed to this by-passing passage possesses a high temperature and a high pressure at the first conduit and it is arranged to be cooled to generate two phases of refrigerant, namely gas-liquid state, both upstream and downstream of the second pressure reduction means. The gas-liquid state of the refrigerant is a saturated condition and this provides the established relationship between the temperature and the saturated vapor pressure. The present invention is directed to sensing of the temperature of the refrigerant in these saturated states, thereby detecting continuous variations in the pressure from the temperature values sensed by thermal sensors disposed along the by-passing passage at the portions upstream and downstream of the second pressure reduction means.

One aspect of the present invention is featured by the fact that cooling of refrigerant in the first conduit may be effected by refrigerant flowing through the second conduit. This is accomplished by disposing both first and second conduits in a particular mode whereby the heat exchanger is formed by these two conduits. Such heat exchanger may be constructed in a spiral shape and the second pressure reduction means may be disposed within the spirally shaped heat exchanger thereby contributing to the compactness of the concerned elements. The spirally formed heat exchanger composed by the first and second conduits may be made in a double tube form in which one conduit passes through the inside of the other and refrigerant flows in opposite directions inside and outside of the inner tube. Also, the two conduits may be made such as to be in contact with each other in the longitudinal direction and soldered together. Of course, another type of heat exchanger formed completely within the by-passing passage or in combination with other means outside of the by-passing passage may be employed.

Further objects and advantages of the present invention will be more fully understood from the detailed explanation of the invention, which follows the brief explanation of the drawings summarized below.

DETAILED DESCRIPTION OF INVENTION

Before explaining the present invention, a brief explanation of prior art would be beneficial for better understanding the present invention.

Figure 1:
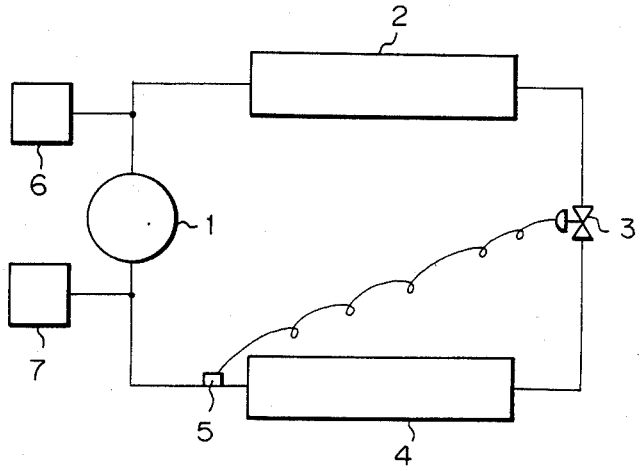
Fig. 1 (PRIOR ART)
FIG. 1 is a simplified schematic illustration of a heat pump system of prior art.

Referring now to FIG. 1, there is schematically shown a conventional heat pump system which comprises a compressor 1, a condenser 2, a pressure reduction means 3 such as a thermal expansion valve, an evaporator 4, a temperature sensor 5 for the thermal expansion valve 3, a high pressure sensing switch 6 disposed at an outlet of the compressor 1 and a low pressure switch 7 disposed at an inlet of the compressor 1. The pressure switches 6 and 7 are conventional ones. The above elements are connected through passages indicated by lines through which heat transfer medium or refrigerant is filled and circulated within the system. (For convenience, the term "refrigerant" will be used to designate this heat transfer medium in the specification and claims.) In this system, the refrigerant is compressed to a high pressure by the compressor 1 and the pressurized refrigerant gas is condensed to liquid at the condenser 2 while simultaneously discharging heat. The liquid state refrigerant is fed to the thermal expansion valve 3 where the pressure of the refrigerant is reduced so that the refrigerant is given a low temperature and low pressure. Such refrigerant absorbs heat at the evaporator 4 to become gas again which is fed to the compressor 1 so as to complete the circulating cycle within the system. The pressures in the system are detected by the pressure switches 6 and 7 when the discharge pressure of the compressor 1 exceeds the pre-set value of the high pressure switch 6 or the intake pressure of the compressor 1 falls below the pre-set value of the low pressure switch 7. If the high pressure switch 6 is actuated, the pressure may be lowered by increasing the fan speed of the condenser 2, decreasing the fan speed of the evaporator 4, decreasing the revolutional speed of the compressor 1 or a combination of these steps. Also, when the pressure switch 7 is actuated, the pressure may be increased by varying the fan speed of the condenser, evaporator and/or revolutional speed of the compressor in the opposite manner to that employed when the presusre switch 6 is actuated. Thus, the elements involved in the system are controlled by the pressure switches 6 and 7 when the pressure variation at the respective switches traverses the predetermined threshold values at these switches. Thus, as stated earlier, controlling of the conventional system is not effected in a continuous manner and in cases where the pressures are to be sensed at plural points, provision of plural pressure detectors or switches would become necessary, thereby increasing the total cost of the system.

Figure 2:
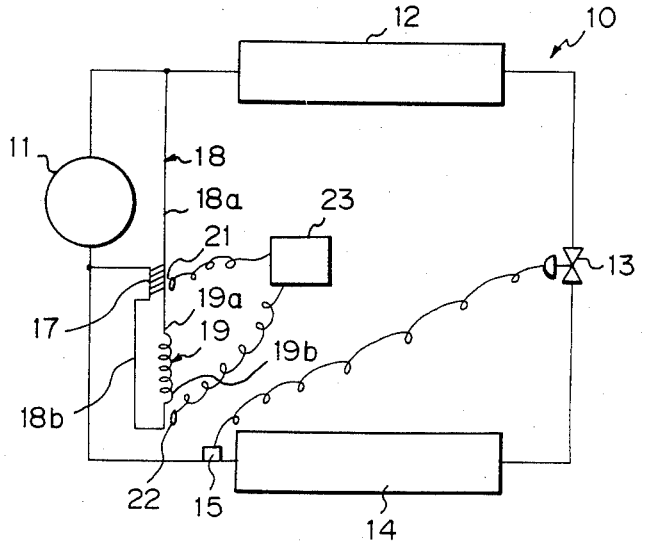
FIG. 2 schematically shows an embodiment of a heat pump system according to the present invention.

Now an embodiment constructed in accordance with the present invention will be reviewed. In FIG. 2, a heat pump system 10 according to the present invention is schematically illustrated.

The system 10 comprises a compressor 11, a condenser 12, a thermal expansion valve 13 (which is referred to as a first pressure reduction means for convenience), an evaporator 14 and conduits connecting the above-mentioned elements which constitute a primary passage for passing a heat transfer medium through these elements. The elements 11, 12, 13 and 14 are substantially the same as those identified by reference numerals 1, 2, 3 and 4 in FIG. 1, respectively. Also, a thermal sensor 15 is provided which is a sensor similar to the sensor 5 in FIG. 1. This primary passage is divided into a high pressure segment extending from an outlet of the compressor 11 to an inlet of the first pressure reduction means 13 and a low pressure segment extending from an outlet of the pressure reduction means 13 to an inlet of the compressor 11. In addition to the primary passage above, the system 10 comprises a by-passing passage 18 connecting the high pressure segment of the primary passage to the low pressure segment of the primary passage through a second pressure reduction means 19. The by-passing passage 18 consists of a first conduit **18*a* and a second conduit 18*b* at opposite sides of the second pressure reduction means 19 which may be constructed as a capillary tube 19 having an inlet 19*a* and an outlet 19*b*. There is provided a heat exchanger 17 between the first conduit 18*a* and the second conduit 18*b* so that the thermal medium flowing in the first conduit 18*a* towards the capillary tube 19 is cooled by the same medium flowing in the second conduit 18*b* towards the low pressure segment. Thus, generation of the two phases namely liquid and gas states are promoted in the by-passing passage 18. Whilst the heat exchanger 17 in this embodiment is illustrated to effect a heat transfer between the first and second conduits 18*a* and 18*b*, other means may be employed to produce such two phases, namely the gas-liquid phase in the by-passing passage. A first thermal sensor 21 and a second thermal sensor 22 are provided in combination with a thermal detector 24 so as to sense the temperature of the two phased refrigerant in the first conduit 18*a* at the intermediate portion of the heat exchanger 17 (by the sensor 21) and at the outlet 19*b* of the capillary tube 19 (by the sensor 22**).

Figure 3:
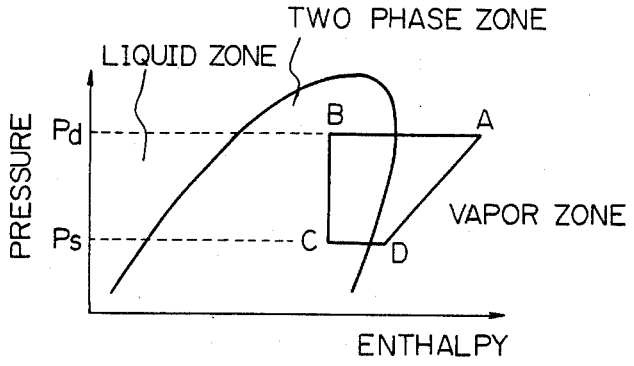
FIG. 3 is a Molier Diagram indicating pressures of refrigerant relative to enthalpy in the various portions of the system shown in FIG. 2.

FIG. 3 shows, in a Molier diagram, several states of the refrigerant at points within the main elements of the heat pump system when the system is in operation and illustrates pressure relative to the enthalpy, the following symbols being employed.

Pd: discharge pressure of the compressor 21,

Ps: suction pressure,

A, B, C and D: states of refrigerant at the outlet of the compressor 21, the inlet **19*a* of the capillary tube 19, the outlet 19*b* of the capillary tube 19, and the inlet of the compressor 21**, respectively.

Figure 4:
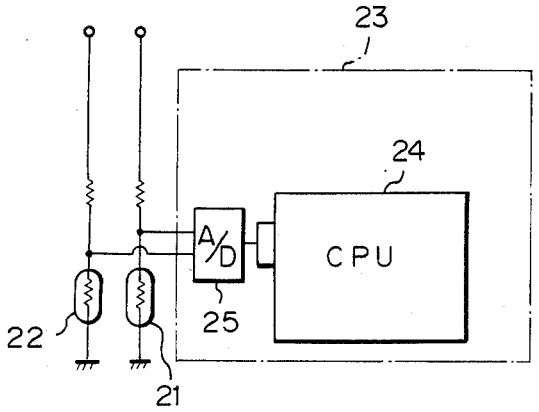
FIG. 4 schematically shows a heat sensing device employed in the system shown in FIG. 2.

In FIG. 4, there is shown an example of the temperature detector 23 which is constructed by an electronic controller 24 and its associated circuits to which the first and second thermal sensors 21, 22 are coupled through an A/D convertor 25; the controller 24 may be the M8748 type manufactured by Mitsubishi Denki Kabushikikaisha, Tokyo.

Figure 5:
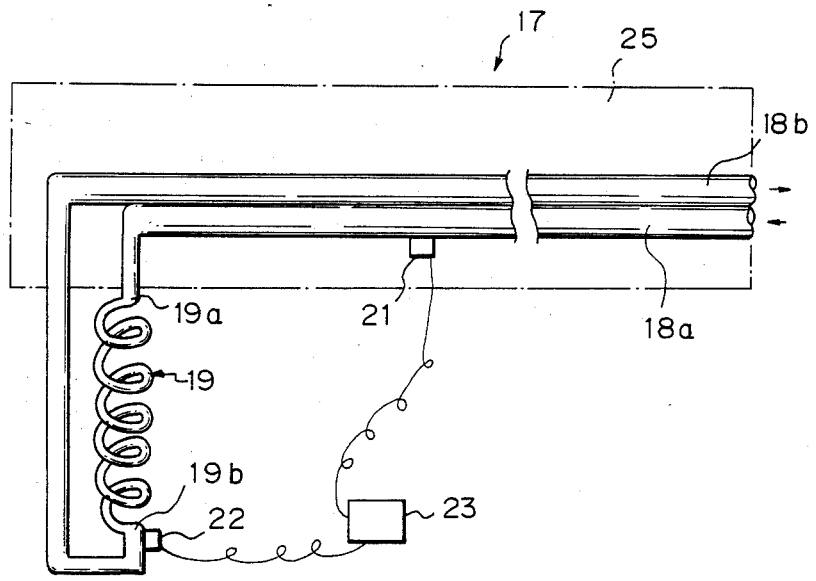
FIG. 5 illustrates a heat sensing device and its installation relative to an auxiliary heat exchanger.

The heat exchanger 17 together with its sensing system is schematically illustrated in FIG. 5 which is disposed in the by-passing passage 18. The arrows indicate the flowing directions of the refrigerant. The heat exchanger 17 is surrounded by a heat insulating layer 25.

When the system shown in FIG. 2 is actuated, a part of the compressed refrigerant gas having a high temperature under a high pressure is introduced into the by-passing passage 18 from the high pressure segment of the primary passage and it flows through the first conduit **18*a* where the compressed gas is cooled at the heat exchanger 17. Therefore, the refrigerant changes its state from A to B in FIG. 3 and it exhibits two phases, i.e. a gas-liquid state, at an approximately intermediate portion of the heat exchanger 17. Then the refrigerant is passed through the capillary tube 19 where the pressure thereof is reduced to the suction pressure of the compressor, thereby changing its state from B to C in FIG. 3 and becoming two phases, with its temperature lowered. The refrigerant is further passed through the second conduit 18*b* and is heated at the heat exchanger 17 so that it becomes vapor and flows into the compressor under state D in FIG. 3. The thermal sensors 21 and 22 detect, in combination with the temperature detector 23, the temperautres of the saturated condition at the respective portions where they are located under the pressure of two phases, namely the liquid-gas state of the refrigerant. As schematically illustrated in FIG. 4, the variation in resistance of the sensor 21 or 22 due to the temperature change is sensed as a change in the electrical potential. Thus, in the present invention, the high pressure is detected on the basis of the relationship between the temperature and the saturated pressure, that is, the high pressure is sensed through the first thermal sensor 21 and the low pressure is sensed through the second thermal sensor 22. The values corresponding to the pressures obtained from the relationship between the temperature and the saturated pressures are utilized as signals for controlling the operation of the heat pump system according to the present invention. In this way, the control is effected continuously in response to variations in the pressure. The system illustrated in FIG. 5** may therefore be referred to as the thermal sensing device.

Figure 6:
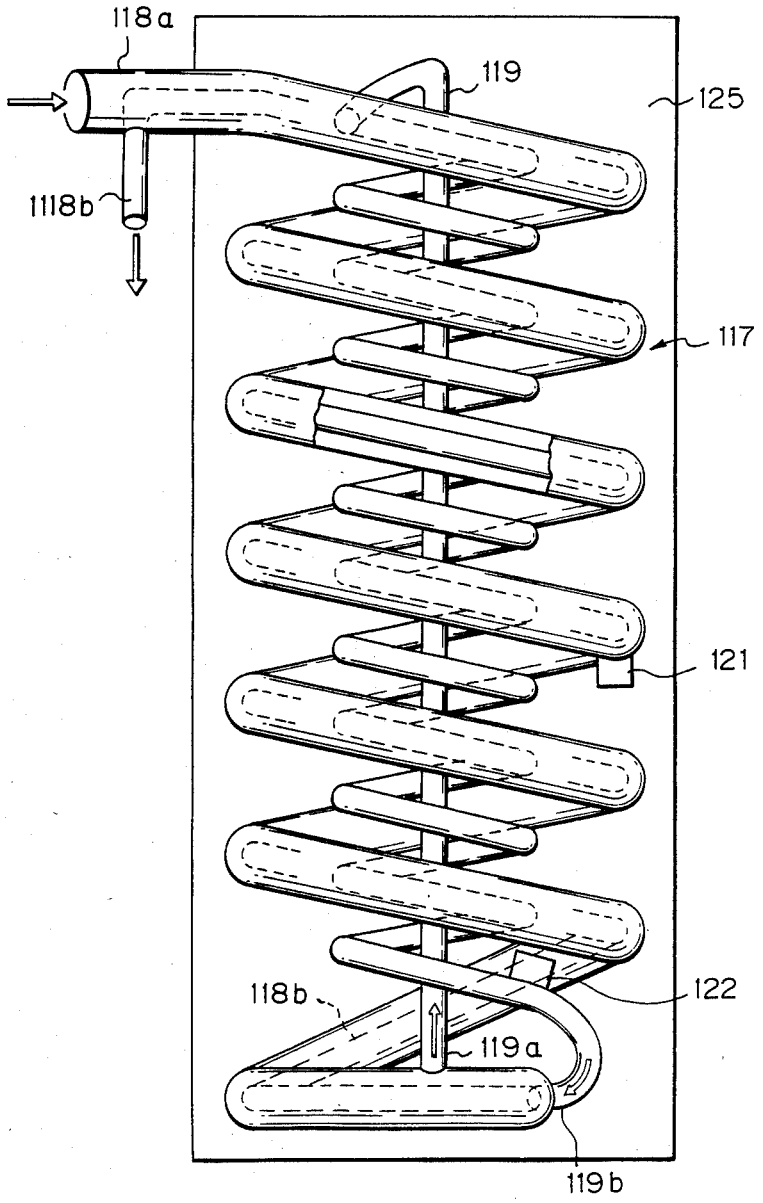
FIG. 6 shows an another modification of the heat sensing device shown in FIG. 5.

Whilst the embodiment explained above referring to FIGS. 2 thru. 5 exhibits satisfactory operation, the lengthwise dimension of the heat exchanger 17 or the thermal sensing device is relatively long and, thus, application of the heat insulating layer 25 involves a troublesome operation and the resultant configuration would become complex. As a modification capable of making this thermal sensing device compact, an alternative arrangement is illustrated in FIG. 6 wherein those portions which are similar in function to those in the previous embodiment are given the same reference numerals with the prefix "1" added thereto, respectively. The function of these portions is the same as the corresponding portions in the previous embodiment. A capillary tube 119 is disposed centrally in a coiled form having an inlet 119*a* and an outlet 119*b*. A first conduit 118*a* is formed in a spiral shape such as to more or less coaxially surround the capillary tube 119 and is coupled to the capillary tube 119 at the inlet 119*a* thereof. The capillary tube 119 is coupled to a second conduit 118*b* of its outlet 119*b*. The second conduit 118*b* is arranged to be smaller in diameter than the first conduit 118*a* so that the second conduit 118*b* is received inside the first conduit 118*a* formed in the spiral shape so that a doubled spiral conduit is formed as a heat exchanger 117 by the coaxial arrangement of the first and second conduits 118*a* and 118*b*. The thermal sensors 121 and 122 are disposed as illustrated the respective locations of which correspond to the sensors 21 and 22 relative to the first and second conduits 18*a* and 18*b* in FIG. 2 or FIG. 5. With such an arrangement, an insulation layer 125 may be applied easily and this arrangement contributes to the compactness of the system.

Figure 7:
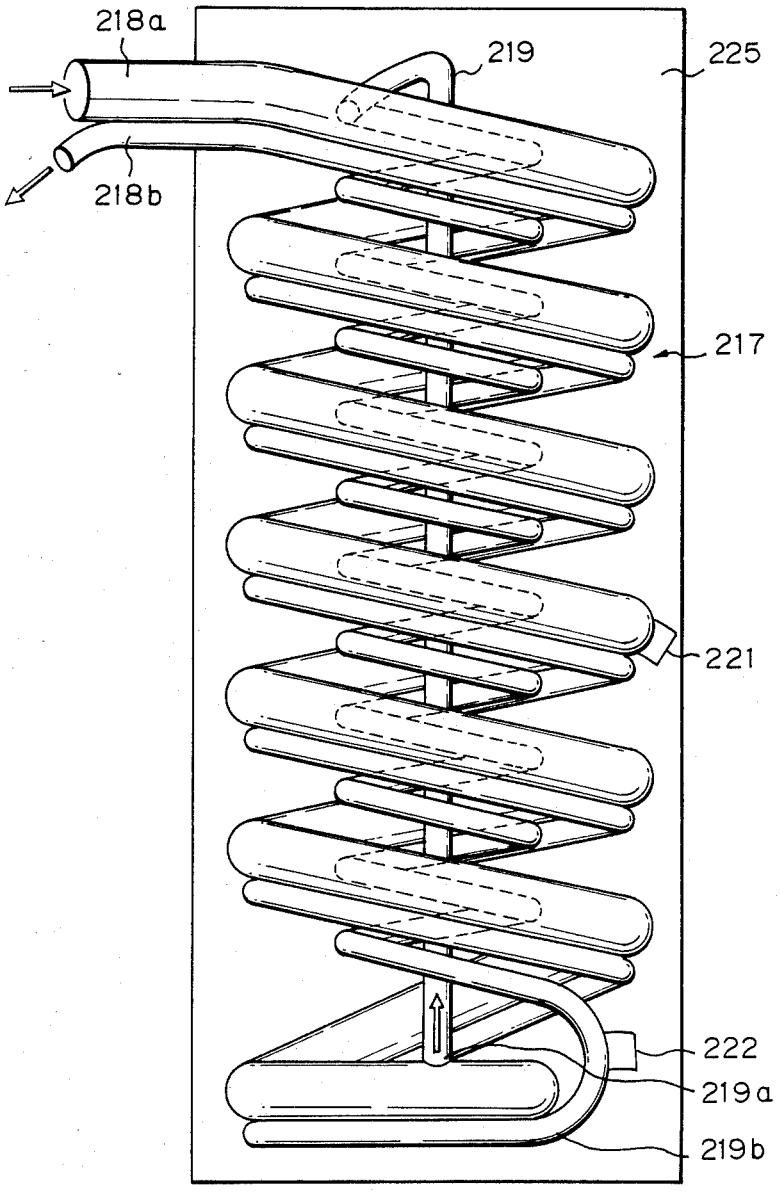
FIG. 7 shows further modification of the heat sensing device shown in FIG. 6.

Further modification of the combination of the heat exchanger and associated sensors or the thermal sensing device is illustrated in FIG. 7 wherein the reference numerals are given to the concerned portions in a manner similar to that in FIG. 6 except that the prefix "2" is added to each of the portions which correspond to the respective portions of the first embodiment. As seen from this drawing, first and second conduits are soldered together for a certain length to mutually conduct heat therebetween and to form a heat exchanger. With this arrangement too, the thermal sensing system is made compact and an insulation layer 225 may be applied to cover the device easily.

In the system shown in FIG. 2, the by-passing passage 18 was disposed together with the heat exchanger 17 and the thermal sensing device between the high pressure segment and the low pressure segment of the primary passage and, thus, the heat exchanger 17 was formed between the first and second conduits 18*a* and 19*b* to provide portions enabling generation of the two phased state, namely, the gas-liquid state of the refrigerant. In other words, the heat exchanger 17 was formed completely within the by-passing passage 18. However, such heat exchanger may be formed between the first conduit of the by-passing passage and the low pressure segment of the primary passage.

Figure 8:
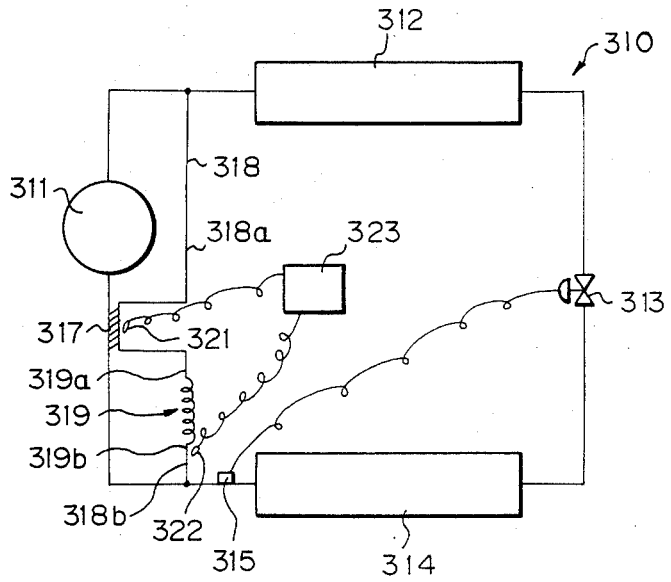
FIG. 8 is another embodiment of the present invention similar to that shown in FIG. 2.

Such modified system 310 is schematically illustrated in FIG. 8. In this drawing, the portions similar to those in FIG. 2 are given the same reference numerals as in FIG. 2 with the prefix "3" added thereto, respectively. A by-passing passage 318 is disposed between the high pressure segment and the low pressure segment of the primary passage and a heat exchanger 317 is formed between a first conduit 318*a* and the conduit of the low pressure segment which is just upstream of the inlet of a compressor 311 where vaporized refrigerant flows.

A further modification is also available such as replacement of the conduit for the cooling side, e.g. the conduit 318*a*, or the low pressure segment of the primary passage in FIG. 8, or with a cooling fan utilizing ambient air.

Also, though the second pressure reduction means has been illustrated as a capillary tube in the foregoing, it may be replaced by an appropriate orifice or nozzle.

Also, the respective locations of the two thermal sensors such as 21 and 22 shown in FIG. 2 need not necessarily be disposed at the points explained or illustrated. For instance, these sensors may be disposed at places where the two phase state of refrigerant is present.

The heat pump system according to the present invention is constructed in such a manner as explained above and, thus, it gives data regarding the pressure based on the temperature sensed, the temperature sensed being that corresponding to the saturated pressure of the refrigerant, whereby variations in the pressure may be detected continuously. The heat exchanger arrangement and the second pressure reduction means provided in the by-passing passage according to the present invention contributes to the ability to assuredly generate the two phase state, i.e. the gas-liquid state, of refrigerant thereby providing a heat pump system capable of stably sensing the temperature through which the system is continuously controlled.

The present invention has been explained in detail by referring to specific embodiments; however, the present invention is not limited to those explained and may be modified or changed by those skilled in the art within the scope and spirit of the present invention which is defined by the claims appended hereto.

What is claimed is:

1. A heat pump system comprising:

a compressor;

a condenser;

a first pressure reduction means;

an evaporator;

a primary passage coupling said compressor, condenser, and first pressure reduction means in the sequence listed for circulating refrigerant therethrough to complete a heat transfer cycle, said primary passage including a high pressure segment extending from an outlet of said compressor to an inlet of said first pressure reduction means and a low pressure segment extending from an outlet of said first pressure reduction means to an inlet of said compressor;

a by-passing passage for connecting said high pressure segment to said low pressure segment;

a second pressure reduction means disposed in said by-passing passage;

means for cooling refrigerant flowing through said by-passing passage from said high pressure segment towards said low pressure segment for generating two phases of refrigerant, namely a gas-liquid state of the refrigerant, both upstream and downstream of said second pressure reduction means;

a first thermal sensor for detecting the temperature of the two phase refrigerant upstream of said second pressure reduction means; and a second thermal sensor for detecting the temperature of the two phase refrigerant downstream of said second pressure reduction means.

2. A heat pump system as claimed in claim 1 wherein said by-passing passage comprises a first conduit extending bwtween said high pressure segment and said second pressure reduction means and a second conduit extending between said second pressure reduction means and said low pressure segment.

3. A heat pump system as claimed in claim 1 wherein the high pressure side of said by-passing passage is coupled to said high pressure segment between the outlet of the compressor and a portion of said condenser where the gas state of the refrigerant exists.

4. A heat pump system as claimed in claim 1 wherein the temperature of the refrigerant is lowered in the by-passing passage by the refrigerant within the system having a lower temperature and a lower pressure.

5. A heat pump system as claimed in claim 4 wherein the refrigerant in the by-passing passage is cooled by the refrigerant flowing through the portion downstream of the evaporator.

6. A heat pump system as claimed in claim 4 wherein the refrigerant in the by-passing passage is cooled by the refrigerant flowing through the portion downstream of said second pressure reduction means.

7. A heat pump system as claimed in claim 2 wherein said first thermal sensor is disposed along said by-passing passage between a cooling portion of said first conduit and an inlet of said second pressure reduction means.

8. A heat pump system as claimed in claim 2 wherein said second thermal sensor is disposed along said by-passing passage between an outlet of said second pressure reduction means and a portion of said second conduit where the refrigerant receives heat energy from the refrigerant flowing through said first conduit.

9. A heat pump system as claimed in claim 2 wherein said means for cooling the refrigerant is constructed as a heat exchanger composed by arranging a certain length of said first conduit and a certain length of said second conduit in a manner such as to effect heat transfer between the refrigerant in said first conduit and the refrigerant in said second conduit.

10. A heat pump system as claimed in claim 9 wherein one of said conduits is made smaller in its diameter than the other for said certain length so that said one conduit is passed coaxially through the inside of the other conduit to form a double walled tube.

11. A heat pump system as claimed in claim 9 wherein said heat exchanger is formed by arranging said certain lengths of said first and second conduits such as to be in contact with each other in the longitudinal direction of the conduits.

12. A heat pump system as claimed in claim 9 wherein said first thermal sensor is arranged to sense the temperature of the refrigerant in said first conduit at an intermediate portion of said heat exchanger.

13. A heat pump system as claimed in any of claims 9, 10, 11 or 12 wherein said first conduit and second conduit are formed such as to make a spirally shaped heat exchanger and said second pressure reduction means is a spirally formed tube which is disposed inside said spirally shaped heat exchanger and is connected at opposite ends thereof to said first and second conduits respectively, said heat exchanger being enclosed within a heat insulating layer.

14. A heat pump system as claimed in claim 9 wherein said first thermal sensor is arranged to sense the temperature of the refrigerant in the first conduit at a portion between said heat exchanger and said second pressure reduction means.

15. A heat pump system as claimed in claim 10 wherein said one conduit having the smaller diameter is said certain length of said second conduit.

* * * * *